United States Patent [19]

Haltof et al.

[11] Patent Number: 4,598,498

[45] Date of Patent: Jul. 8, 1986

[54] JAMB LINER SASH STOP

[75] Inventors: Garry P. Haltof; Eugene S. Stephens, both of Rochester; Zygmunt J. Czubachowski, North Chili, all of N.Y.

[73] Assignee: Caldwell Manufacturing Company, Rochester, N.Y.

[21] Appl. No.: 730,088

[22] Filed: May 3, 1985

Related U.S. Application Data

[63] Continuation-in-part of Ser. No. 651,522, Sep. 17, 1984, abandoned.

[51] Int. Cl.[4] ..... E05D 15/16

[52] U.S. Cl. ..... 49/407

[58] Field of Search ..... 49/407

[56] References Cited

U.S. PATENT DOCUMENTS 3,121,923 2/1964 Bruyn et al. ..... 49/407

3,418,754 12/1968 Beasley, Jr. et al. ..... 49/407

*Primary Examiner*—Philip C. Kannan

*Attorney, Agent, or Firm*—Stonebraker, Shepard & Stephens

[57] ABSTRACT

A nail-bearing sash stop 20 mounts on a jamb liner 10 having a parting bead 11 between a pair of sash runs 12 and 13. Retainer slots 15 in opposite sides of parting bead 11 adjacent sash runs 12 and 13 engage and hold a longitudinal side edge of stop 20 for retaining stop 20 on jamb liner 10 before assembly and for allowing sash stop 20 to move longitudinally of jamb liner 10 during assembly. A preferred embodiment of stop 20 has opposite side edges 41 that can be sprung together for a resilient fit between parting bead 11 and guide wall 14 in a sash run spaced from parting bead 11.

21 Claims, 7 Drawing Figures

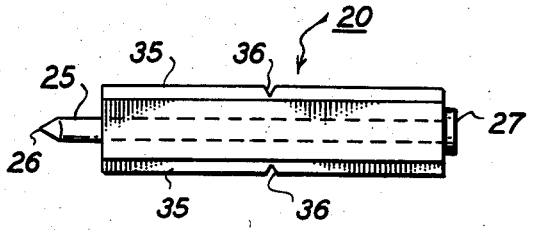
FIG. 1
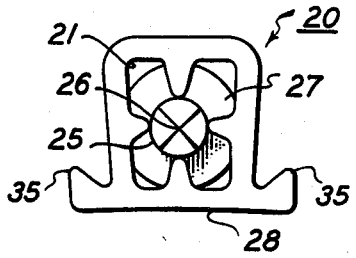
FIG. 2
FIG. 3
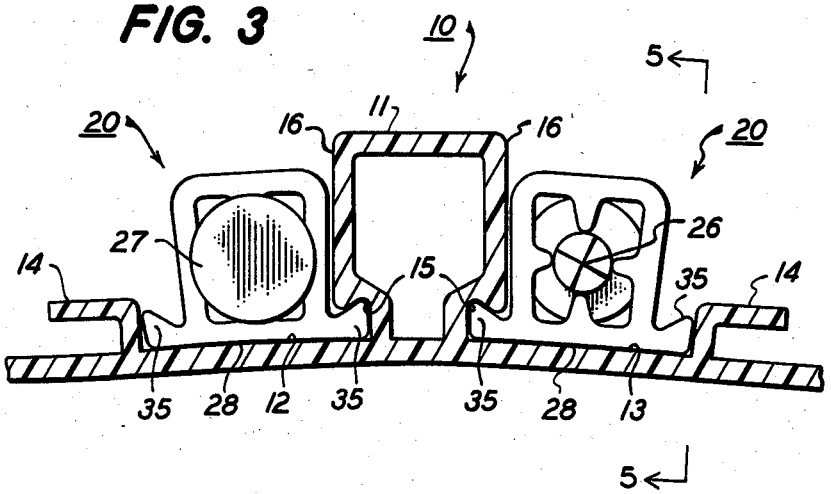
FIG. 4
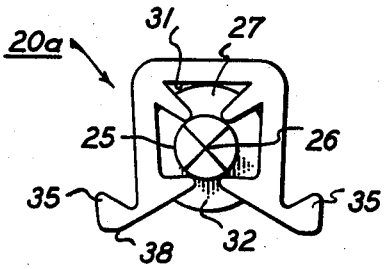
FIG. 5
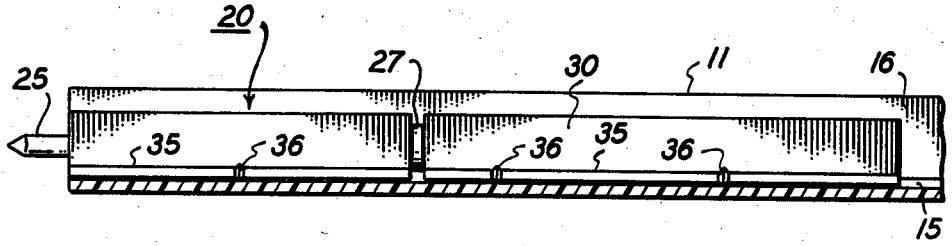

JAMB LINER SASH STOP

RELATED APPLICATIONS

This application is a Continuation-In-Part of our parent application Ser. No. 651,522, filed Sept. 17 1984, entitled Jamb Liner Sash Stop, and abandoned upon the filing of this Continuation-In-Part applicaton.

BACKGROUND

Sash stops are used in jamb liners to limit the uppermost travel of the lower sash and the lowermost travel of the upper sash. Sash stops are also used to carry nails that are driven into a window frame during assembly to fix upper and lower positions of the jamb liners within the frame. A preferred way of driving such nails is by slamming a sash to its limit of travel against a pair of stops as the window is assembled into its frame. This quickly sets both stop nails and accurately locates the ends of the jamb liners within the frame.

Although sash stops have been proposed to accomplish all this, problems remain. Sash stops mounted on flange edges of jamb liners fall from their mountings as jamb liners are handled before window assembly, and missing sash stops must be manually replaced. Previous sash stops have not been easily varied in length to satisfy the needs of different window assemblies. Also, prior art sash stops have deviated from manufacturing tolerances and have added too much to the cost of window assemblies.

We have devised a sash stop that solves all these problems. Our sash stop is reliable, effective, variable in length, inexpensive, able to meet manufacturing tolerances, and able to stay in place during preassembly handling.

SUMMARY OF THE INVENTION

Our sash stop has an extruded body with a longitudinal nail-holding cavity and is arranged to mount on a sash run of a jamb liner adjacent a parting bead. Opposite longitudinal edges of the sash stop can fit into retainer slots formed in the parting bead adjacent the sash run. For sash runs having guide walls in plow regions spaced from the parting bead, the opposite edges of the sash stop fit between the parting bead and the guide wall. Also, the opposite sides of the sash stop are preferably resilient so that its opposite edges can be sprung toward each other for mounting on a jamb liner.

DRAWINGS

FIG. 1 is a plan view of a preferred embodiment of our sash stop;

FIG. 2 is an end elevational view of the sash stop of FIG. 1;

FIG. 3 is a cross-sectional view of a jamb liner bearing a pair of the stops of FIGS. 1 and 2 arranged for stopping upper and lower sash;

FIG. 4 is an end elevational view of an alternative preferred embodiment of our sash stop;

FIG. 5 is a fragmentary, cross-sectional view of a jamb liner bearing our sash stop and a stop extender;

DETAILED DESCRIPTION

Figure 6:
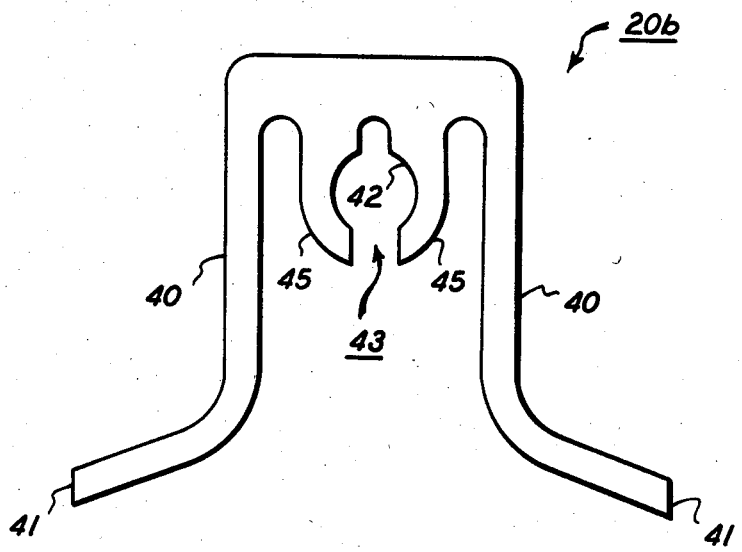
FIG. 6 is an end elevational view of another preferred embodiment of our sash stop.

Our sash stop 20 is preferably extruded of resin and works with extruded resin jamb liner 10 that is also preferably extruded of resin. Stop 20 has a longitudinal inside cavity 21 carrying the shank of a nail 25 having a head 27 engaging one end of stop 20 and a point 26 extending beyond the opposite end of stop 20.

Jamb liner 10 has a parting bead 11 separating a pair of sash runs 12 and 13, each of which has a rail or guide wall 14 in a plow region spaced from parting bead 11. Recessed into each opposite sash side 16 of parting bead 11 is an interlock or retainer slot 15 adjacent sash runs 12 and 13. A pair of interlock projections 35, shaped to interlock with slots 15, extend laterally outward from opposite sides of bottom region 28 along the longitudinal length of stop 20.

Interlock projection 35 and interlock slots 15 have corresponding dovetail shapes for an interlocking fit as shown in FIG. 3. The distance along bottom region 28 between the outer edges of interlock projections 35 approximates the distance from the insides of interlocking slots 15 to sash run walls 14 so that while one projection 35 is interlocked in a slot 15, the opposite projection 35 abuts against wall 14. This positions stop 20 snuggly in place in a sash run where it is held reliably on jamb liner 10 and will not fall off during preassembly handling.

Interlocking a stop projection 35 in a parting bead slot 15 disposes a stop 20 adjacent parting bead 11 in a sash run where it can function as a sash stop. Having interlock projections 35 on both sides of stop 20 allows each stop to be located on either side of parting bead 11 so that a single stop can serve for either an upper or lower sash.

Stops 20 can be slid into the ends of jamb liner 10 by inserting an interlock projection 35 into an interlock slot 15 and moving stop 20 longitudinally into a sash run. As this is done, each stop 20 is oriented so that the points 26 of nails 25 extend up and down at the respective top and bottom ends of jamb liner 10. Then when window sash are assembled into a frame including jamb liner 10, nails 25 can be driven into the top and bottom of the window frame by slamming the lower sash up and the upper sash down. This drives a sash against nail heads 27, moves stops 20 against the window frame, and drives the points 26 of nails 25 into the window frame. Nails 25 then hold the stops in place and fix the upper and lower ends of jamb liner 10 in the proper position relative to the assembled sash.

An alternative preferred embodiment of stop **20*a* as shown in FIG. 4 has a bottom region 38 formed with a longitudinal opening 32 into internal cavity 31 containing nail 25, which can be pressed laterally into cavity 31 through opening 32. With such an arrangement, stop 20*a* can be extruded with interlock projections 35 spaced wider apart than the normal distance between an interlock slot 15 and sash run wall 14, and interlock projections 35 can be squeezed slightly together as stop 20*a* is inserted into jamb liner 10. This helps accommodate manufacturing tolerances and gives interlock projections 35 a snug resilient fit between interlock slots 15 and walls 14**.

Periodic dimples 36 formed in projections 35 can increase the friction of longitudinal movement of interlock projections 35 in interlock slots 15 as shown in FIG. 5. We now prefer, however, to use the frictional resilience of springing longitudinal stop edges together in a mount on a jamb liner as explained above for stop 20*a* and as explained below for stop 20*b*.

A stop extender 30 can increase the length of a sash stop by simply adding an appropriate length of stop extrusion adjacent a nail-bearing stop 20 as shown in FIG. 5. Stop extender 30 also has interlock projections 35 and is cut to whatever length is desired to precede stop 20 into an interlocking fit with jamb liner 10. Nail-bearing stop 20 is disposed at the end of jamb liner 10 where its nail 25 can be driven into the window frame by movement of the sash against extender 30, which in turn drives nail 25 of stop 20.

Figure 7:
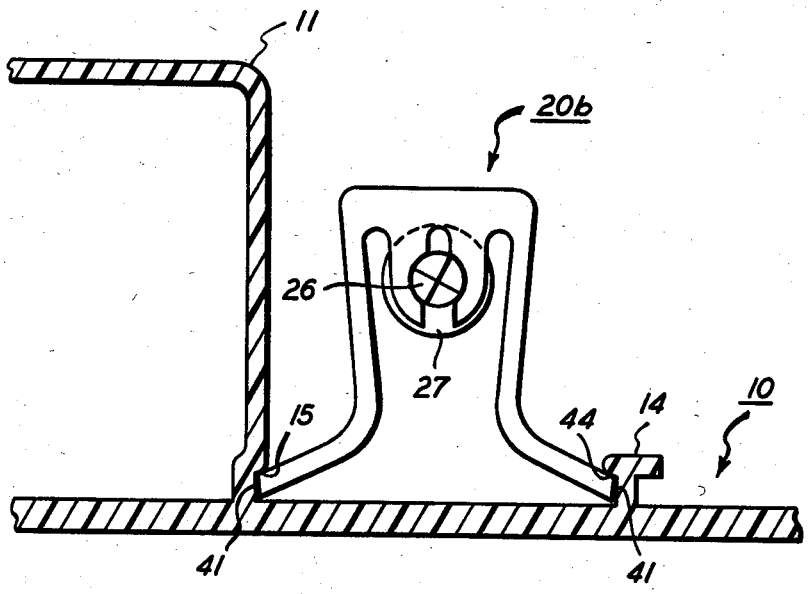
FIG. 7 is a cross-sectional view of a jamb liner mounting the sash stop of FIG. 6.

Another preferred embodiment of our sash stop 20*b* appears in FIGS. 6 and 7. Sash stop 20*b* has resilient longitudinal side limbs 40 that flare outward to opposite side edges 41 that are normally spaced apart more widely than the distance between parting bead 11 and sash run guide walls 14. Resilience of side limbs 40 allows side edges 41 to be sprung toward each other for a frictional resilient fit between parting bead 11 and guide wall 14.

Besides retainer grooves 15 in parting bead 11 for receiving side edges 41, jamb liner 10 preferably also has a retainer slot 44 in guide wall 14 oriented to face toward retainer slot 15 in parting bead 11. Opposed retainer grooves 15 and 44 then receive opposite side edges 41. Resilience of sprung-together side limbs 40 presses side edges 41 outward into the opposed retainer grooves 15 and 44, not only for holding stop 20*b* in place on jamb liner 10, but also for producing a frictional engagement between stop 20*b* and jamb liner 10. This allows stop 20*b* to move longitudinally in a sash run, but holds stop 20*b* with sufficient friction to prevent it falling out of jamb liner 10 before window assembly. Instead of sliding stop 20*b* longitudinally into jamb liner 10, stop 20*b* can be pressed laterally into a snap fit position between parting bead 11 and guide wall 14.

Between side limbs 40, longitudinal nail-holding cavity 42 has longitudinal slot 43 through which a nail can be pressed laterally into cavity 42. Also, the side walls 45 of cavity 42 are formed to be resilently independent of side limbs 40 so that presence of nail in cavity 42 does not affect the resilient springing together of side edges 41.

Stop 20*b* can be mounted on both sides of parting bead 11 as suggested for stop 20 in FIG. 3 to orient nails facing up and down for upper and lower sash stops as previously described. Sash stop extender 30 as shown in FIG. 5 can also be made of a length of the same extrusion that forms sash stop 20*b* and can be positioned longitudinally adjacent sash stop 20*b* as previously explained. In such a position, sash stop extender 30 resiliently mounts between parting bead 11 and guide wall 14 in the same way as sash stop 20*b*.

We claim:

1. In a sash stop and jamb liner wherein said jamb liner has a parting bead between a pair of sash runs and said sash stop has an extruded body with a longitudinal inside cavity receiving a nail longer than said body, the improvement comprising:

a. opposite sides of said parting bead having retainer slots adjacent said sash run; and b. opposite longitudinal edges of said sash stop being receivable into said retainer slots for holding said sash stop in a longitudinally movable position adjacent said parting bead where said opposite longitudinal edges engage said sash run.

2. The improvement of claim 1 including a stop extender formed of a longer length of the same extrusion that forms said body of said sash stop so that said sash stop and said stop extender can be arranged longitudinally adjacent each other in said sash run.

3. The improvement of claim 1 wherein said nail-receiving cavity has a longitudinal slot between said longitudinal edges, and said slot is arranged so that said nail can be pressed laterally into said cavity.

4. The improvement of claim 1 wherein said sash run has a guide wall extending along a plow region spaced from said parting bead, and one of said longitudinal edges of said sash stop engages said guide wall .

5. The improvement of claim 4 wherein said longitudinal edges of said sash stop are normally spaced apart by a distance larger than the distance from said parting bead retainer slot to said guide wall so that said opposite longitudinal edges of said sash stop are sprung together to fit between said parting bead and said guide wall.

6. The improvement of claim 5 wherein said guide wall has a retainer slot receiving said longitudinal edge of said sash stop.

7. The improvement of claim 6 wherein said longitudinal edges of said sash stop are normally spaced apart by a distance larger than the distance from said parting bead retainer slot to said guide wall so that said opposite longitudinal edges of said sash stop are sprung together to fit between said parting bead and said guide wall.

8. A method of mounting a nail-holding sash stop on a jamb liner having a parting bead between a pair of sash runs, said method comprising:

a. forming retainer slots in opposite sides of said parting bead adjacent said sash runs; and b. forming opposite edges of said sash stop to engage said sash run and to fit in said retainer slots so that said sash stop is retained for longitudinal movement in said sash run adjacent said parting bead.

9. The method of claim 8 including forming a sash stop extender longer than said sash stop and having said opposite edges arranged for supporting said sash stop extender in said sash run longitudinally adjacent said sash stop.

10. The method of claim 8 including forming a guide wall in a sash plow region of said sash run spaced from said parting bead and arranging one of said edges of said sash stop to engage said guide wall.

11. The method of claim 10 including forming said opposite edges of said sash stop to be resiliently spaced apart by a distance larger than the distance between said parting bead and said guide wall so that said opposite edges of said sash stop are sprung together between said parting bead and said guide wall.

12. The method of claim 11 including forming a retainer slot in said guide wall to receive and retain said edge of said sash stop.

13. A mounting for a nail-holding sash stop on a jamb liner having a parting bead between a pair of sash runs having guide walls in plow regions spaced from said parting bead, said mounting comprising:

a. side edges of said sash stop being arranged for running along said sash run between said parting bead and said guide wall;

b. said side edges of said sash stop being normally spaced farther apart than the distance between said parting bead and said guide wall so that said side edges are resiliently sprung together when said sash stop is positioned between said parting bead and said guide wall; and c. grooves formed adjacent said sash run in opposite sides of said parting bead and in said guide walls to receive and retain said side edges of said sash stop.

14. The mounting of claim 13 including a stop extender having side edges the same as said side edges of said sash stop and positioned longitudinally adjacent said sash stop between said parting bead and said guide wall.

15. A jamb liner sash stop system including an extruded sash stop bearing a nail and an extruded jamb liner having a parting bead arranged between a pair of sash runs having guide walls equally spaced from said parting bead, said system comprising:

a. resilient longitudinal side limbs of said sash stop being arranged for engaging either of sais sash runs between said parting bead and said guide walls; and b. said longitudinal side limbs of said sash stop being spaced wider apart than the distance between said parting bead and said guide walls so that said side limbs are sprung together for frictionally retaining said sash stop between said parting bead and said guide wall.

16. The system of claim 15 including a longitudinal nail-holding cavity having an opening between said longitudinal side limbs for pressing said nail laterally into said cavity.

17. The system of claim 15 including retainer grooves formed adjacent said sash run on opposite sides of said parting bead and on each of said guide walls for receiving said side limbs of said sash stop.

18. The system of claim 17 including a sash stop extender having longitudinal side limbs the same as said longitudinal side limbs of said sash stop and arranged longitudinally adjacent said sash stop between said parting bead and said guide wall.

19. A sash stop having an extruded resin body with a longitudinal cavity for receiving a nail longer than said body, said sash stop comprising:

a. resilient, longitudinal side limbs on opposite sides of said body;

b. said side limbs arranged to flare outward and terminate at side edges disposed for engaging a sash run; and c. resilience of said side limbs allowing said side edges to be sprung toward each other in mounting said sash stop.

20. The sash stop of claim 19 wherein said nail-holding cavity has a longitudinal slot between said side limbs so that said nail can be pressed laterally through said slot into said cavity.

21. A jamb liner having an extruded body forming a parting bead between a pair of sash runs having guide walls equally spaced on opposite sides of said parting bead, said jamb liner comprising:

a. retainer grooves formed on opposite sides of said parting bead adjacent said sash run;

b. corresponding retainer grooves formed in said guide walls on opposite sides of said parting bead to open toward said parting bead; and c. distances between said retainer grooves in said parting bead and said guide walls being equal on opposite sides of said parting bead.

* * * * *